US005624325A

United States Patent [19]

Smith

[11] Patent Number: 5,624,325

[45] Date of Patent: Apr. 29, 1997

[54] GOLF BALL TEEING APPARATUS

[76] Inventor: Michael Smith, 475 W. Main St. Lot #4, Delta, Ohio 43515

[21] Appl. No.: 537,453

[22] Filed: Oct. 2, 1995

[51] Int. Cl.[6] ..... A63B 57/00

[52] U.S. Cl. ..... 473/137; 473/133

[58] Field of Search ..... 473/132, 133, 473/134, 135, 136, 137

[56] References Cited

U.S. PATENT DOCUMENTS

| | | | |
|---|---|---|---|
| D. 348,497 | 7/1994 | Tange . | |
| 2,171,299 | 8/1939 | Beckett | 473/137 |
| 3,003,770 | 10/1961 | Jones | 473/137 |
| 4,265,453 | 5/1981 | Loof | 473/137 |
| 4,391,446 | 7/1983 | Eberle . | |
| 4,676,397 | 6/1987 | Hoffmeister . | |
| 4,732,391 | 3/1988 | Karr . | |
| 4,796,893 | 1/1989 | Choi | 473/137 |
| 4,817,955 | 4/1989 | Hickson et al. . | |
| 4,892,318 | 1/1990 | Jennings . | |
| 4,957,296 | 9/1990 | Turnidge et al. . | |
| 4,995,614 | 2/1991 | Tange . | |
| 5,022,657 | 6/1991 | Bussiere et al. . | |
| 5,071,131 | 12/1991 | Turnidge et al. . | |
| 5,096,200 | 3/1992 | Komori et al. . | |
| 5,282,628 | 2/1994 | Komori et al. . | |
| 5,310,194 | 7/1994 | Copeland . | |
| 5,326,107 | 7/1994 | Park . | |
| 5,346,222 | 9/1994 | Luther, Sr. | 473/137 |
| 5,411,267 | 5/1995 | Burks et al. . | |
| 5,415,409 | 5/1995 | Hellman . | |
| 5,458,339 | 10/1995 | Wildes | 473/137 |
| 5,464,223 | 11/1995 | Dermott | 473/137 |

OTHER PUBLICATIONS

"Potpourri" Catalog (holiday 1987).

*Primary Examiner*—Steven B. Wong
*Attorney, Agent, or Firm*—Marshall & Melhorn

[57] ABSTRACT

A golf ball teeing apparatus provides a container for holding a plurality of golf balls and a dispensing mechanism for delivering the balls from the container to the driving tee. The dispensing mechanism and container are mounted on a frame which is secured to a base or mat. The golf ball teeing apparatus includes a pivoting mechanical channel arm with an integral blocking mechanism to dispense one golf ball at a time. The apparatus also includes an anti-jamming rods interlocked with the mechanical arm which agitates the golf ball in the container to prevent jamming of the balls about the discharge channel of the storage container. A stationary, fixed channel is integrally formed in the bottom of the container and includes an external extension and discharge end for directing the balls from a discharge opening in the container. A second channel is a pivoting, movable channel arm. One end of the channel arm is positioned at the discharge end of the fixed channel and is pivotably connected to the frame. The other end of the channel arm is provided with an aperture for depositing the golf ball on a tee.

15 Claims, 3 Drawing Sheets

GOLF BALL TEEING APPARATUS

BACKGROUND OF THE INVENTION

1. Field of the Invention

The present invention relates to a golf ball teeing apparatus for teeing up a series of golf balls on a practice tee, and more particularly, to a container for holding the golf balls and a dispensing mechanism and movable channel arm for delivering a golf ball from the container to a practice tee.

2. Summary of Related Art

Golf is a well known sport throughout the world and continues to grow in popularity. Golf is also a demanding sport which requires regular practice in order to maintain and improve the skills of a golfer. In addition to playing rounds of golf on a golf course, golfers typically practice on a regular basis by hitting balls at a driving range. In addition to the traditional outdoor driving ranges, golfers now use indoor driving ranges and home-use driving nets to practice.

When practicing their driving at a driving range, the golfers are required to tee up a golf ball on a practice tee after every shot. This repeated bending to tee up the ball is tiresome, especially for elderly golfers or golfers with back or weight problems.

A golf ball teeing apparatus provides an efficient and less tiresome method for teeing up golf balls at a driving range. Another benefit of the golf ball teeing apparatus is that the golfer can maintain his feet and grip in the same position when hitting the balls. The ability to maintain stance and grip improves concentration and provides a repetitive stroke capability which is often beneficial in a practice situation.

A number of golf teeing devices have been developed to assist the golfer in teeing up the golf ball during a practice session. Such devices have been expensive to purchase and install. The golf ball teeing devices have also been mechanically and/or electrically complex, which often makes such devices more difficult to use and maintain. The golf ball teeing apparatus is typically used outdoors in a somewhat difficult environment. The device, if used at a public driving range, may be subject to somewhat abusive use in operation. The golf ball teeing apparatus must have rugged construction and be easy to maintain.

Owners and users of the golf ball teeing apparatus also desire a device that is portable and easy to set up. A golf ball teeing apparatus that is light weight and portable can be stored when not in use and then conveniently moved to the driving range for use.

U.S. Pat. No. 4,391,446 to Eberle discloses a dispenser with a movable arm maintained in spring tension. The arm pivots in a horizontal plane and includes a dispensing head at the fixed end of the dispenser tube to limit the flow of golf balls into the tube. The golfer must rotate the arm with the club and then tilt or rock the dispensing head forwardly to release the first ball and then rearwardly to position the ball on the tee and block the other balls. The golf balls have a tendency to jam up in the hopper and the dispensing head is difficult to coordinate.

A motor driven teeing apparatus is disclosed in U.S. Pat. No. 4,732,391 to Karr. This teeing apparatus requires a motor and complex gear assembly to position the arm mechanism.

U.S. Pat. Nos. 4,957,296 and 5,071,131 to Turnidge et al. also disclose a vertical arm for dispensing golf balls. The device includes an operating pedestal and pulley system which moves the arm from an upright position to dispenses a golf ball. The device includes an upper and lower golf ball stop to prevent more than one ball at a time from entering the guide track.

U.S. Pat. No. 4,995,614 to Tange discloses a vertical arm with a return spring. Tange describes the frequent problem of golf ball jams in the storage hopper of a golf ball teeing apparatus. The golf ball dispenser shown in Tange includes internal baffles with a zig-zag vertically rising single column to eliminate the possibility of balls jamming in the storage hopper.

Another golf ball teeing apparatus is disclosed in U.S. Pat. No. 5,326,107 to Park. The arm is motorized and moves only in a horizontal direction. A guide wire is used to maintain the ball on the arm until the ball is positioned above the tee.

Although a number of golf ball teeing devices are known, a multitude of mechanisms and installation requirements result in complex operations. The devices are expensive and difficult to maintain such that few golf ball teeing apparatus have achieve success in the market place.

A need exists for a golf ball teeing device which is low cost, and simple to manufacture, use, and maintain. The device should be light weight and portable. The golf ball teeing device must be able to accurately position one golf ball at a time on the tee. Another important feature required in a golf ball teeing apparatus is the ability to dispense a number of balls from a storage hopper without the balls jamming.

SUMMARY OF THE INVENTION

In accordance with the present invention, there is provided a golf ball teeing apparatus having a pivoting mechanical channel arm with an integral blocking mechanism to dispense one golf ball at a time. The apparatus also includes an anti-jamming means interlocked with the mechanical arm which agitates the golf ball in the storage container to prevent jamming of the balls about the discharge channel.

The golf ball teeing apparatus of the present invention includes a container or storage hopper for holding a plurality of golf balls and a dispensing mechanism for delivering the balls from the container to the driving tee. The dispensing mechanism and container are mounted on a frame which is secured to a base or mat. The base can either be permanently affixed to a surface or designed for portable use and positioning.

The dispensing mechanism includes two channels or chutes. The first channel is a stationary, fixed channel which is integrally formed in the bottom of the container and includes an external extension and discharge end for directing the balls from a discharge opening in the container. The second channel is a pivoting, movable channel arm. One end of the channel arm is positioned at the discharge end of the fixed channel and is pivotably connected to the frame. The other end of the channel arm is provided with an aperture along the bottom surface of the channel arm which is slightly larger than the size of a golf ball.

In operation, the starting position of the channel arm is maintained at a vertical angle of between 60–90 degrees by a spring tension means. The channel arm has a bracket formed on the body of the channel arm with a spring connected between the bracket and the outer surface of the container. The spring maintains the channel arm at the desired angle to (1) prevent golf balls from entering the channel arm, and (2) to provide clearance at the driving tee so that the golfer can swing a club.

The channel arm includes a bar or other engagement device mounted directly on the channel arm to permit the golfer to depress the channel arm into alignment with the fixed channel to facilitate the gravitational roll of the ball from the fixed channel through the discharge opening in the container and into the channel of the channel arm. When the channel arm is fully extended, the aperture at the free end of the channel arm is positioned over the golf tee such that the ball exits the channel arm and rests atop the tee as the golfer releases the pressure on the engagement device. The golfer can activate the entire operation with a golf club from an upright stance.

The fixed end of the channel arm includes an inverted V-shaped, cam-like device which is recessed when the channel arm is at rest in a vertical position. When the channel arm is pivoted into a horizontal position, the device swings up to block the discharge end of the fixed channel such that only one golf ball is permitted to enter the channel arm when the engagement device is pushed down. As the channel arm is released back to its upright position, the next ball in sequence in the fixed channel rolls into position.

One problem which frequently occurs in dispensing golf balls through a single aperture is that the golf balls will jam about the opening such that no golf balls will be dispensed. The present invention includes two agitating bars which have one end rotatably connected to the channel arm. The agitating bars extend through the front wall of the container and into the storage area where the golf balls are retained. The agitating arms are positioned adjacent the fixed channel at the bottom of the container. When the movable arm is pressed down and then released to dispense a golf ball, the arms agitate the golf balls to ensure that the balls do not jam above the fixed channel at the discharge point from the container.

An object of the present invention is to provide a golf ball dispensing apparatus which is low cost and simple to manufacture and maintain.

A further object of the present invention is to accurately position a golf ball on the tee and to dispense the golf balls one at a time from the fixed channel extending from the container of golf balls.

Another object of the present invention is to provide an anti-jamming mechanism which is inexpensive, yet effective in preventing the golf balls from jamming at the discharge opening in the container.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
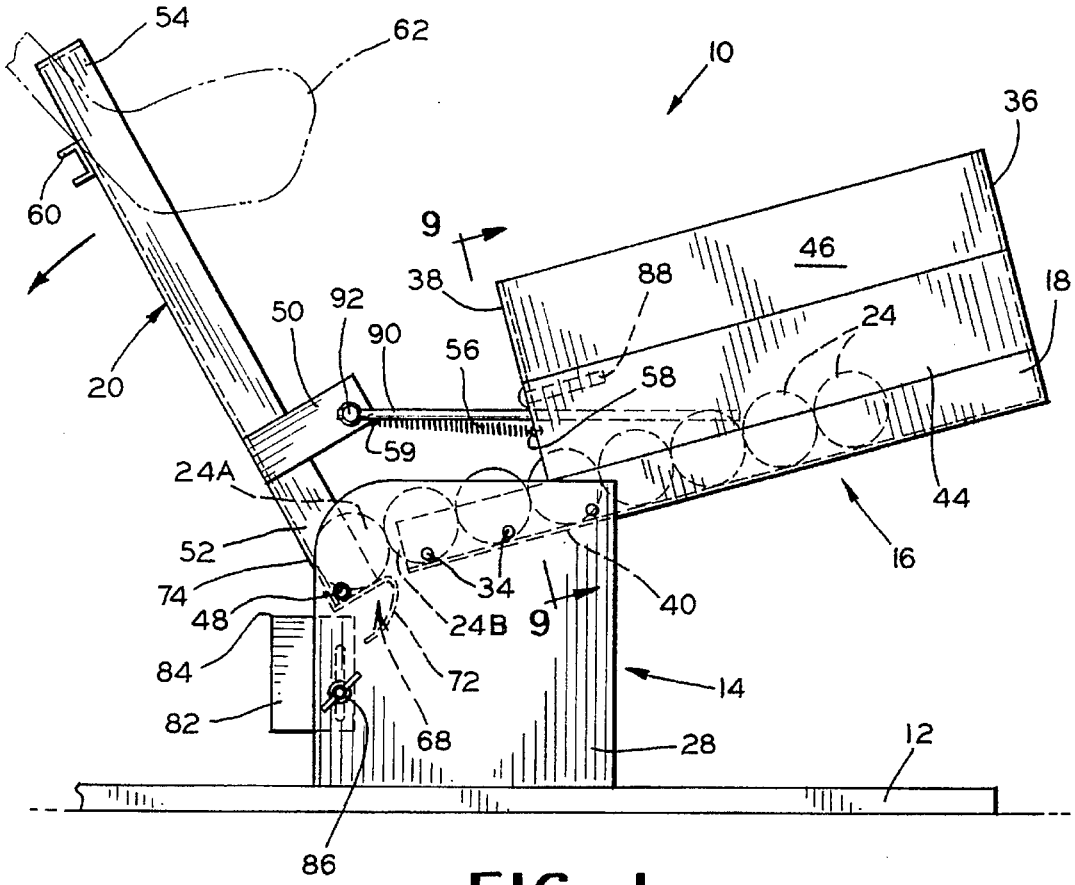
FIG. 1 is a side elevational view of the golf ball teeing apparatus of the present invention with the channel arm in a retracted position.

Referring now to the drawings, there is shown in FIGS. 1–4 a golf teeing apparatus 10 mounted on a base 12. The apparatus 10 includes a frame 14, a storage container 16 with fixed channel 18, and a movable channel arm 20.

The base 12 provides a planar surface and can be made from any durable, light weight material. The base 12 is generally sized to support the apparatus 10 and provide stability when the apparatus 10 is in use. A larger-sized base 12 can be provided which would include a driving tee 22 mounted in the base for teeing golf balls The golf ball teeing apparatus 10 can be mounted in a number of different ways and be used as a portable or fixed device with a portable or fixed base 12. The main requirements for mounting the apparatus 10 is that the apparatus be positioned at the proper distance from a driving tee 22, and that the apparatus 10 be maintained at such a position during use so that the channel arm 20 can repeatedly place a golf ball 24 on the tee 22.

The structure of the apparatus 10 is relatively compact and can be made from light-weight materials to facilitate the carrying of the apparatus 10. A handle or other carrying mechanism (not shown) could be affixed directly to the apparatus 10 or to a portable base 12 with apparatus 10 to facilitate the transport of the apparatus 10 to and from the tees at a driving range.

The mounting frame 14 includes a base segment 26 and two mounting plates 28 extending perpendicular to the base segment 26. The mounting plates 28 are spaced apart for receiving and securing the fixed channel 18 and the channel arm 20. The mounting frame 14 may be made from metal, plastic, or other rigid material which can support the weight of the container 14 and golf balls 24.

Figure 4:
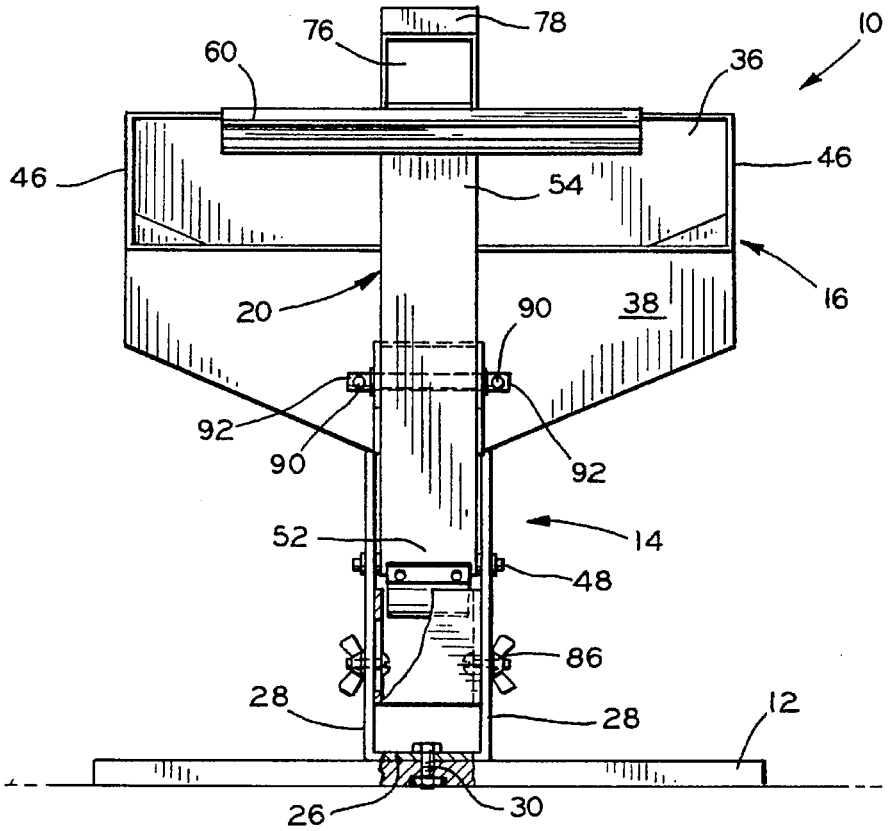
FIG. 4 is a front elevation view of the golf ball teeing apparatus with the channel arm in a retracted position.
Figure 5:
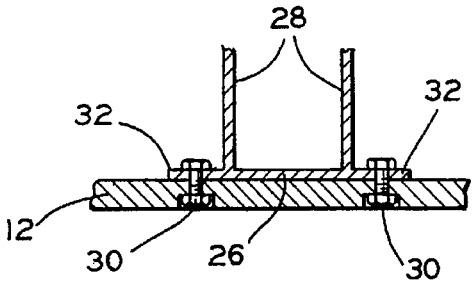
FIG. 5 is alternative embodiment for mounting the base of the golf teeing apparatus to a fixed base.

Two different mounting configurations are shown in FIG. 4 and FIG. 5. The base segment 26 of frame 14 is bolted to the base 12 by bolts 30. The bolts 30 may be positioned between the mounting plates 28 (FIG. 4) or outside of the mounting plates 28 on flanged extensions 32 (FIG. 5) of the base segment 26. Other different mounting configurations and mounting means may be used to secure the frame 14 so long as the apparatus 10 is maintained in the desired position during operation. For example, the frame 14 could even be mounted directly into the ground (without a base 12) adjacent a driving tee 22 by using stakes or other similar mounting devices.

The container 16 and fixed channel 18 are integrally formed and secured between the mounting plates 28 of the frame 14 by rivets 34 or other suitable fastening means. The container 16 and fixed channel 18 may be made from fabricated sheet metal, plastic, or a combination of sheet metal and plastic. The fixed channel 18 is generally made from metal to ensure smooth travel of the golf balls 24.

The fixed channel 18 is a U-shaped channel which extends which is formed in the bottom of the container 16. The fixed channel 18 starts at the back wall 36 and includes a front extension 40 extending through the front wall 38 of the container 16. The front extension 40 of the fixed channel 18 is positioned and secured between the mounting plates 28. The fixed channel 18 is an integral part of the container 16 and has sufficient strength and rigidity to support the container 16.

The fixed channel 18 and container 16 are mounted at a downward angle such that gravitational force causes the golf balls 24 in the fixed channel 18 to roll towards the front extension 40 through an aperture 42 in the lower edge of the front wall 38. The bottom walls 44 of the container are also sloped from the side walls 46 to the fixed channel 18 such that any golf balls 24 in the container 16 will be directed towards the channel 18 and pass through the aperture 42.

The size and shape of the container 16 can be modified to accommodate any reasonable number of golf balls 24. In the generally rectangular configuration shown in FIGS. 1–4, the size of the back wall 36, front wall 38, and side walls 44 can be extended to retain more golf balls 24.

Figure 2:
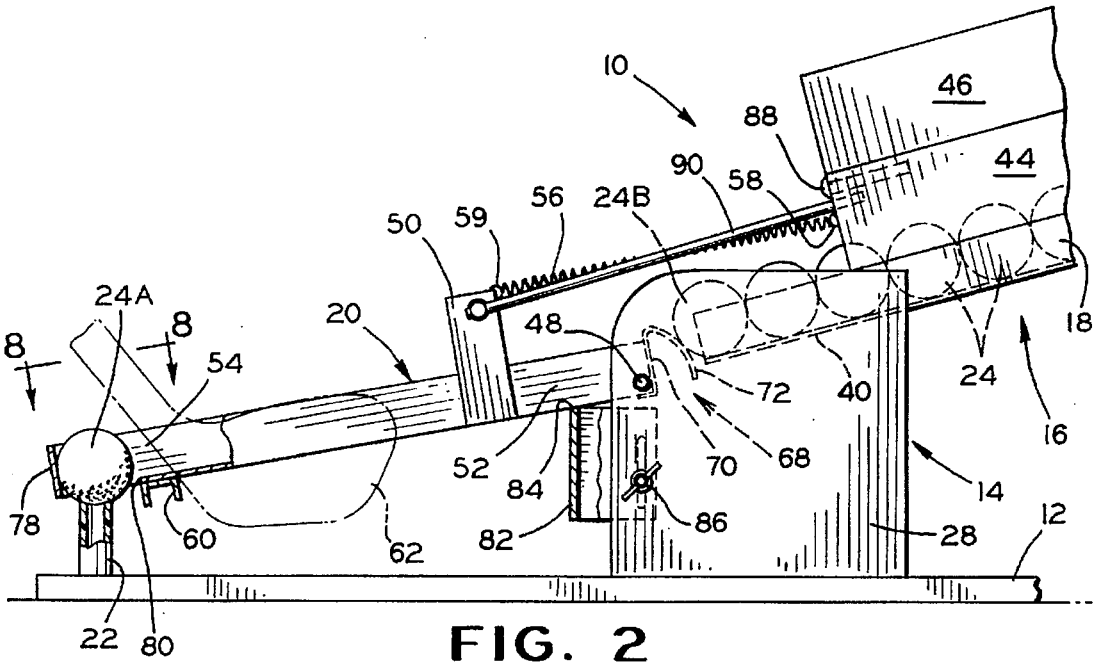
FIG. 2 is a side elevational view of the golf ball teeing apparatus with the channel arm in an extended position, the channel arm being engaged by the head of a golf club for placement of a golf ball on the tee.

The movable channel arm 20 is a U-shaped channel of the same channel size as the fixed channel 18. The channel arm 20 is pivotably connect between the mounting plates 28 and is generally aligned with the front extension 40 of the fixed channel 18 as shown in FIGS. 1–2. A pivotable connector 48 facilitates the pivoting of the channel arm 20 from a retracted position in FIG. 1 to an extended position in FIG. 2. The length of the channel arm 20 is sized such that the golf balls can be delivered to the tee 22 in the extended position and then be retracted so as to not interfere with the swing of the golfer when hitting the golf ball 24.

A bracket 50 is secured to the body channel arm 20 towards the pivot end 52 of the channel arm 20. The bracket 50 is sized so as not to interfere with the delivery of the golf balls 24 from the pivot end 52 to the free end 54 of the channel arm 20.

A spring 56 has one end 58 secured to the front wall 38 above the aperture 42. The second end 59 of the spring 56 is secured to the bracket 50 in a known manner. The spring 56 is sized to retain the channel arm 20 in the retraced position at an angle of between 60–90 degrees from the base 12 with minimal force so as not to unduly restrict the pivot action of the channel arm 20.

A club bar 60 or other similar engagement means is secured to the body of the channel arm 20 towards the free end 54 of the channel arm 20. A golfer using the apparatus 10 would take the club head 62 to engage the club bar 60 and to forcibly pivot the channel arm 20 from the retracted position (FIG. 1) to an extended position (FIG. 2). The force needed to pivot the channel arm 20 is minimal such that the golfer can easily move the channel arm 20 to the desired position for dispensing a golf ball 24. Once the ball 24 is in position, the pressure on the club head 62 is released and the spring 56 returns the channel arm 20 to the retracted position.

Figure 6:
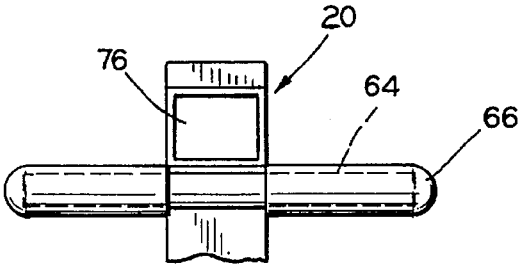
FIG. 6 is fragmentary front elevational view of the cross bar and aperture at the end of the movable tube.

As shown in FIG. 6 the club bar 60 consists of a rigid core 64 surrounded by padding material 66 so as not to damage the club head 62. A non-abrasive surface target area, such as a pad with the approximate size of the club head 62 could be connected to the club bar 60 to ensure proper engagement of the club head 62.

Figure 7:
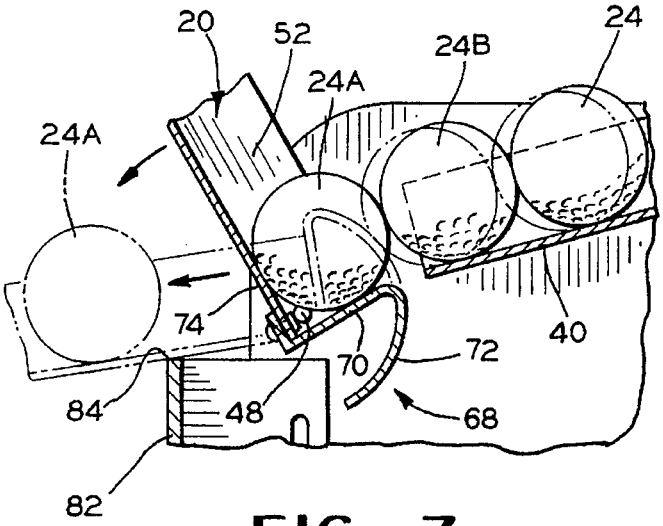
FIG. 7 is a cross sectional view of the golf ball teeing apparatus at the junction of the fixed channel and the channel arm.

In the golf ball teeing apparatus 10 of the present invention, a retainer 68 in FIG. 7 is included at the pivot end 52 of the channel arm 20 to permit entry of only one golf ball at a time into the channel of the channel arm 20 for each extension. If more than one golf ball entered the channel arm 20 during the pivoting of the channel arm 20 into the extended position, the additional golf balls 24 would knock the initial golf ball 24 off the tee 22. Any of the golf balls 24 which were not discharged from the free end 54 of the channel arm 20 would be directed back towards the pivot end 52 as the channel arm 20 is moved to the retracted position. Such balls 24 would either be dislodged from the channel arm or cause a jam at the end of the front extension 40.

The retainer 68 at the pivot end 52 of the channel arm 20 includes a bridge wall 70 and a retention wall 72. The channel arm 20 and the fixed channel 18 are aligned such that front extension 40 is adjacent the bridge wall 70 to facilitate the rolling acceptance of only one ball 24A from the front extension 40 onto the bridge wall 70 to rest against the base 74 of the channel arm 20 when the arm 20 is in a retracted position.

As the channel arm 20 is pivotably moved by the golfer from a retracted position to an extended position, the golf ball 24A is cradled in the corner formed by the bridge wall 70 and channel base 74 until the channel arm is sloped downward such that the golf ball 24A rolls down the channel arm 20 to the free end 54 of the channel arm 20.

As the channel arm 20 is pivoting to an extended position, the retention wall 72 is inserted between golf ball 24A and golf ball 24B in FIG. 7. The retention wall 72 block golf ball 24B and the other golf balls 24 in the fixed channel 18 such that only one golf ball 24A at a time is in the channel arm 20. When the arm 20 is returned to the retracted position, the retention wall 72 is recessed and the next golf ball 24 rolls onto the bridge wall 70. This process is repeated for each golf ball 24 as the golf balls move from the container 16 down the fixed channel 18 into the channel arm 20.

An aperture 76 is formed at the free end 54 of the channel arm 20 to discharge the golf ball 24A from the channel arm 20 onto the tee 22. The golfer must retain the channel arm 20 at a downward sloped until the golf ball 24A rolls from the pivot end 52 to the free end The free end 54 of the channel arm 20 includes an end wall 78 to direct the ball 24A through the aperture 76 and onto the tee 22. When the channel arm 20 is returned to the retracted position, the golf ball 24A is on the tee 22 and ready for driving by the golfer.

The inner dimensions of the channel arm 20 and the dimensions of the aperture 76 are determined based on the size of a golf ball 24. The size of the aperture 76 must be accurately determined to ensure proper positioning of the golf ball 24A.

Figure 8:
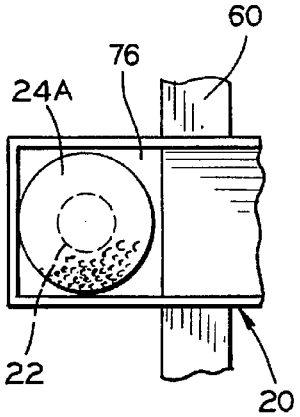
FIG. 8 is a top plan view of the golf ball positioned on the tee taken along the line 8—8 of FIG. 2.

In positioning the apparatus 10 in relationship to the tee 22, the frame 14 must be secured such that the tee 22 is in the center of the aperture 76 when the channel arm is extended. The spacing relationship for the frame 14 is determined primarily by the length of the channel arm 20. FIG. 8 shows the proper alignment of the tee 22 in the center of the aperture 76 with the golf ball 24 resting on the tee 22 prior to release of the channel arm.

Another positioning problem occurs when the arm is over extended or under extended. In both cases, the golf balls 24 have a tendency to roll off of the tee 22. The top of the tee 22 should be at the same height as the inner edge 80 of the aperture 76. The ball 24 is still retained by the wall 78 and is brought to rest on top of the tee 22. If the arm 20 is under extended, the ball 24 is released from the aperture 76 above the tee 22, which frequently causes the ball 24 to bounce off the top of the tee 22. If the arm 20 is over extended, the tee 22 extends through the aperture 76 and the ball 24 is blocked by the tee 22 instead of being positioned on top of the tee 22.

Figure 9:
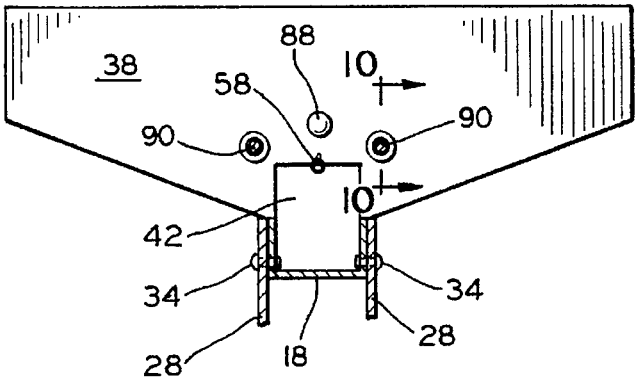
FIG. 9 is a cross sectional view along the line 9—9 of FIG. 1.
Figure 10:
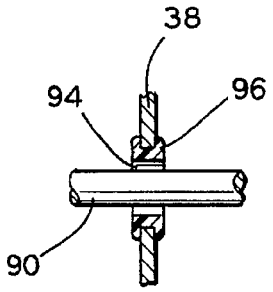
FIG. 10 is a cross sectional view along the line 10—10 of FIG. 9.

An adjustable stop block 82 is mounted between the front edges of the mounting plates 28. The channel arm 20 is pivoted until the channel base 74 engages the corner edge 84 of the stop block 82. The stop block 82 includes an adjustable mounting screws 86 to permit a height adjustment of the stop block 82. The height of the stop block 82 and corresponding extension of the channel arm 20 can be adjusted to provide for the proper positioning height of the tee 22 in relationship to the aperture A problem which frequently occurs in golf ball teeing apparatus is the jamming of balls about a discharge aperture, such as aperture 42 shown in FIG. 9. In order to prevent the golf balls 24 from jamming the aperture 42, an agitation system is included in the container 16 of the present invention.

The agitation system includes a fixed deflector 88 secured to the front wall 38 and extending into the container 16 right above the aperture 42 and the fixed channel 18. The deflector 88 is spaced so as to relieve the weight of the golf balls (not shown) on top of the golf ball 24 in the fixed channel 18 that is ready to pass through the aperture A bolt 88 is shown as the deflector in FIGS. 1–3, but a bracket, flange, or other deflection device extending above the fixed channel 18 could be used in the present invention.

Figure 3:
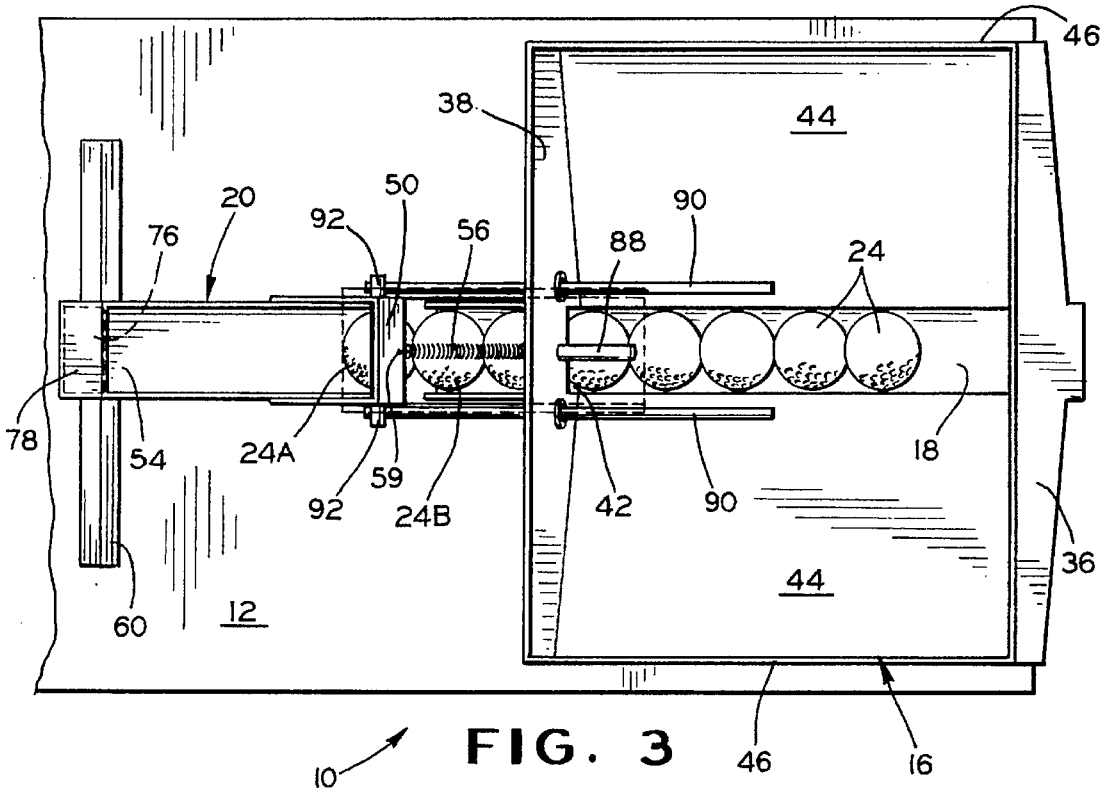
FIG. 3 is a top plan view of the golf ball teeing apparatus.

The sliding rods 90 agitate the golf balls 24 such that the golf balls 24 in the fixed channel 18 are free to roll down the sloped fixed channel 18, out the aperture 42, and into the front extension 40 for delivery to the channel arm 20. FIGS. 1–3 show the positioning of the sliding rods 90 on both sides of the fixed channel 18. The sliding rods 90 are pivotably attached to the bracket 50 at pivot shaft 92. The rods 90 extend through an aperture 94 in the front wall 38 and into the container 16. A gasket or sleeve 96 is placed in the aperture 94 to ensure that the rods 90 slide smoothly in the aperture Each time the channel arm 20 is extended, the golf balls along the fixed channel 18 are agitated as the sliding rods 90 are partially pulled out of the container 16. When the channel arm 20 is retracted, the sliding rods 90 are pushed back into the container 16. This agitation of the golf balls 24 along the fixed channel prevents the balls 24 from jamming. The sliding rods 90 facilitate the rolling of the golf balls 24 down the fixed channel 18 to the aperture 42. The combination of the jamming rods and the sloped configuration of the container 16 also ensures that all of the balls 24 will be discharged from the container 16.

The golf ball teeing apparatus 10 of the present invention provides a rugged and easy to use teeing device. The only maintenance typically required for such an apparatus is the replacement of the springs 56 as the spring tension is lost after a reasonable period of time.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A golf ball teeing apparatus for depositing a golf ball on a tee, said apparatus comprising:

a. a frame;

b. a golf ball storage container mounted on said frame, said container being adapted for storing a plurality of golf balls;

c. an elongate discharge channel formed in a bottom of said container and including a discharge aperture in said container at one end of said channel for discharging the golf balls in sequence from said container;

d. a channel arm pivotably connected to said frame and positioned to receive a golf ball discharged from the discharge aperture in the discharge channel of said container, said channel arm having an elongate body, a pivot end for receiving the golf ball and a free end for depositing the golf ball;

e. an actuator bar connected to the body of said channel arm proximate the free end for pivoting said channel arm, in relationship to said frame, between an upwardly sloping retracted position when receiving the golf ball and a downwardly sloping extended position when transferring the golf ball along said channel arm and depositing the golf ball; and f. at least one agitator rod connected to the body of said channel arm and spaced apart from the pivot end, said agitator extending through a side wall of said container for agitating the plurality of golf balls in said container when said channel arm is pivoted between the retracted position and the extended position.

2. A golf ball teeing apparatus for depositing a golf ball on a tee, said apparatus comprising:

a. a frame;

b. a golf ball storage container mounted on said frame, said container being adapted for storing a plurality of golf balls;

c. an elongate discharge channel formed in a bottom of said container and including a discharge aperture in said container at one end of said channel for discharging the golf balls in sequence from said container;

d. a channel arm pivotably connected to said frame and positioned to receive a golf ball discharged from the discharge aperture in the discharge channel of said container, said channel arm having an elongate body, a pivot end for receiving the golf ball and a free end for depositing the golf ball;

e. an actuator bar connected to the body of said channel arm proximate the free end for pivoting said channel arm, in relationship to said frame, between an upwardly sloping retracted position when receiving the golf ball and a downwardly sloping extended position when transferring the golf ball along said channel arm and depositing the golf ball;

f. a control retainer formed at the pivot end of said channel arm for controlling the receipt of the golf balls, said control retainer including a receiving cavity aligned with said discharge member for receiving a single golf ball from said discharge member when said channel arm is in the retracted position, and a blocking wall which blocks the sequence of golf balls from said discharge member while said channel arm is pivoted to the extended position and returned to the discharge position; and g. at least one agitator rod connected to the body of said channel arm and spaced apart from the pivot end, said agitator extending through a side wall of said container for agitating the plurality of golf balls in said container when said channel arm is pivoted between the retracted position and the extended position.

3. The golf ball teeing apparatus defined in claim 2, wherein said frame includes a pair of parallel, spaced-apart mounting plates and said channel arm is pivotably connected between said plates.

4. The golf ball teeing apparatus defined in claim 2, wherein said discharge channel includes a downwardly sloped, U-shaped channel extending across the bottom of said container.

5. The golf ball teeing apparatus defined in claim 4, wherein said discharge channel includes a downwardly sloped, U-shaped channel formed across the bottom of said container and extending through the aperture in said container, an extension of said fixed channel positioned between said pair of mounting plates adjacent said channel arm.

6. The golf ball teeing apparatus defined in claim 2, including a deflector mounted in said container adjacent said discharge channel.

7. The golf ball teeing apparatus defined in claim 2, wherein said agitator rod includes two rods pivotably connected to said channel arm and extending through the side wall of said container generally parallel to said discharge channel.

8. The golf ball teeing apparatus defined in claim 2, including a bracket formed on said channel arm and a spring connected between said bracket and said container.

9. The golf ball teeing apparatus defined in claim 2, including an aperture formed in the channel arm at the free end for depositing said golf ball.

10. The golf ball teeing apparatus defined in claim 2, wherein said actuator bar includes a cross bar connected transversely to said channel arm.

11. The golf ball teeing apparatus defined in claim 10, wherein said cross bar includes a pad for engagement by the head of a golf club.

12. The golf ball teeing apparatus defined in claim 2, including a stop block mounted on said frame for engaging said channel arm in the extended position.

13. The golf ball teeing apparatus defined in claim 2, wherein said control retainer includes an inverted V-shaped bracket formed at the pivot end of said channel arm such that a first side of the bracket forms a portion of the receiving cavity and a second side of the bracket forms the blocking wall.

14. The golf ball teeing apparatus defined in claim 2, including a base for supporting said frame of the golf ball teeing apparatus.

15. The golf ball teeing apparatus defined in claim 14, including a tee mounted in said base and spaced-apart from said base.

* * * * *